US006470574B1

(12) United States Patent
Strumke, Jr.

(10) Patent No.: US 6,470,574 B1
(45) Date of Patent: Oct. 29, 2002

(54) TICKET SCRAPER AND COIN DISPLAY DEVICE

(76) Inventor: George E. Strumke, Jr., 612 Sprout Brook Rd., Putnam Valley, NY (US) 10579

( * ) Notice: Subject to any disclaimer, the term of this patent is extended or adjusted under 35 U.S.C. 154(b) by 1 day.

(21) Appl. No.: 09/641,098

(22) Filed: Oct. 17, 2000

(51) Int. Cl.[7] ..... B25B 33/00; A47L 13/02

(52) U.S. Cl. ..... 30/169; 30/335; 15/236.07; D32/48; D32/49

(58) Field of Search ..... 30/169, 1, 164.9, 30/162, 335; D11/95; D32/46, 48, 49; 15/236.07

(56) References Cited

U.S. PATENT DOCUMENTS 3,855,700 A * 12/1974 Gerson et al. ..... 30/169 X
4,481,690 A * 11/1984 Simmons ..... 30/169 X
4,558,517 A 12/1985 Gringer
4,654,923 A * 4/1987 Facinne et al. ..... 30/169 X
D290,057 S 5/1987 Licher
4,777,693 A * 10/1988 Diba et al. ..... 15/236.01
4,793,061 A 12/1988 Rizzo, Jr.
4,794,692 A * 1/1989 Wang ..... 30/123
4,881,291 A 11/1989 Ellis
5,009,009 A * 4/1991 Stinson ..... 30/172
5,419,004 A 5/1995 Fox
5,433,004 A * 7/1995 Thompson et al. ..... 30/169
5,497,553 A * 3/1996 Chong ..... 30/162
5,615,441 A * 4/1997 Savini ..... 15/236.07 X
D383,577 S 9/1997 Lyons
D386,856 S * 11/1997 Cefalu et al. ..... D32/46
5,713,232 A 2/1998 Hodge
5,749,578 A 5/1998 Stacey
D408,951 S * 4/1999 Morea et al. ..... D32/46 X
D417,760 S * 12/1999 Quackenbush ..... D32/46
6,009,590 A * 1/2000 Stanford ..... 15/236.07
6,141,999 A * 11/2000 Whittaker et al. ..... 70/456 R
D434,888 S * 12/2000 Hendricks ..... D32/46

* cited by examiner

*Primary Examiner*—Charles Goodman
(74) *Attorney, Agent, or Firm*—Dale J. Ream

(57) ABSTRACT

A ticket scraping device for use with a commemorative coin comprises a two-piece housing having a front section releasably connected to a rear section and defining an opening in a lower end of the housing. The front section further defines a centrally disposed circular aperture while the rear section defines a longitudinally extending slot. The scraping device further includes a slider member having an annular clamping member removably disposed in the housing for releasably holding a coin. The slider member further includes an actuator button disposed in a recess formed in the outer surface of the rear section and having a flange which extends through the slot and is releasably coupled to the clamping member. Therefore, the clamping member along with the coin held thereby may be slidably extended through the opening in the lower end of the housing and retracted within the housing. When extended, the coin is useful for scraping a protective film from a game ticket. When retracted, the coin is completely visible through the circular opening.

18 Claims, 7 Drawing Sheets

TICKET SCRAPER AND COIN DISPLAY DEVICE

BACKGROUND OF THE INVENTION

This invention relates generally to portable scrapers used for scraping protective films from a substrate and, more particularly, to a ticket scraper having a slider member capable of holding a coin which may be displayed when retracted and used as a scraping blade when extended.

Scratch-off type lottery tickets are very common and are regularly purchased by many people at grocery and convenience stores. Many ticket purchases, however, have no convenient means for scraping the protective film from the ticket in order to reveal whether or not they have purchased a winning ticket. The consumer's loose change often provides the needed scraping means. Although several devices have been proposed in the art for scraping the film from a ticket, these devices do not provide a convenient scraping device which also provides a visual association between the scraping device and the state sponsoring the lottery game through the use of a commemorative coin indicating the sponsoring state.

Therefore, it is desirable to have a scraping device which can hold a commemorative coin for extension and retraction relative to a housing. Further, it is desirable to have a scraping device which can display a commemorative coin at a retracted position and can utilize said coin as a scraping blade at an extended position. It is also desirable to have a scraping device in which a commemorative coin may be easily removed and replaced.

SUMMARY OF THE INVENTION

Therefore, a ticket scraper and coin display device according to the present invention includes a housing having a front section removably coupled to a rear section in a snap-fit relationship defining an interior cavity. The lower edges of the front and rear sections, which form a lower end of the scraper device, define an opening through which a coin may be extended. The front section further defines a centrally disposed circular aperture which serves as a window for viewing a coin held within the housing. The rear section defines a longitudinal slot.

The scraping device includes a slider member having a clamping member removably coupled to an actuator button. The clamping member includes a pair of annular arms suitable for frictionally holding a commemorative one-dollar state coin. The actuator button rests in an elongate recess formed in an outer surface of the rear section along the slot and includes a flange extending through the slot and snappably coupled to the clamp member. Therefore, the clamping member along with the coin held thereby may be moved longitudinally upon a user manipulation of the actuator button with a thumb or finger. The clamping member is slidable along a longitudinal path within the housing between a first retracted configuration in which the coin is completely visible through the centrally disposed front section aperture and a second configuration partially extending from the lower end opening.

Therefore, a general object of the invention is to provide a scraping device which can selectably hold a coin in a retractable storage position or an extended position for use as a scraping blade.

Another object of the invention is to provide a scraping device, as aforesaid, in which a coin held therein may be viewed through a display window in a housing when at a retracted configuration.

Still another object of the invention is to provide a scraping device, as aforesaid, having a two-piece housing that may be selectively opened for placing a coin therein corresponding to indicia imprinted on the housing.

Yet another object of the invention is to provide a scraping device, as aforesaid, which is easy to manufacture and use.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A ticket scraping and coin display device 10 according to the preferred embodiment of the present invention will now be described with reference to FIGS. 1 through 8 of the accompanying drawings.

Figure 7:
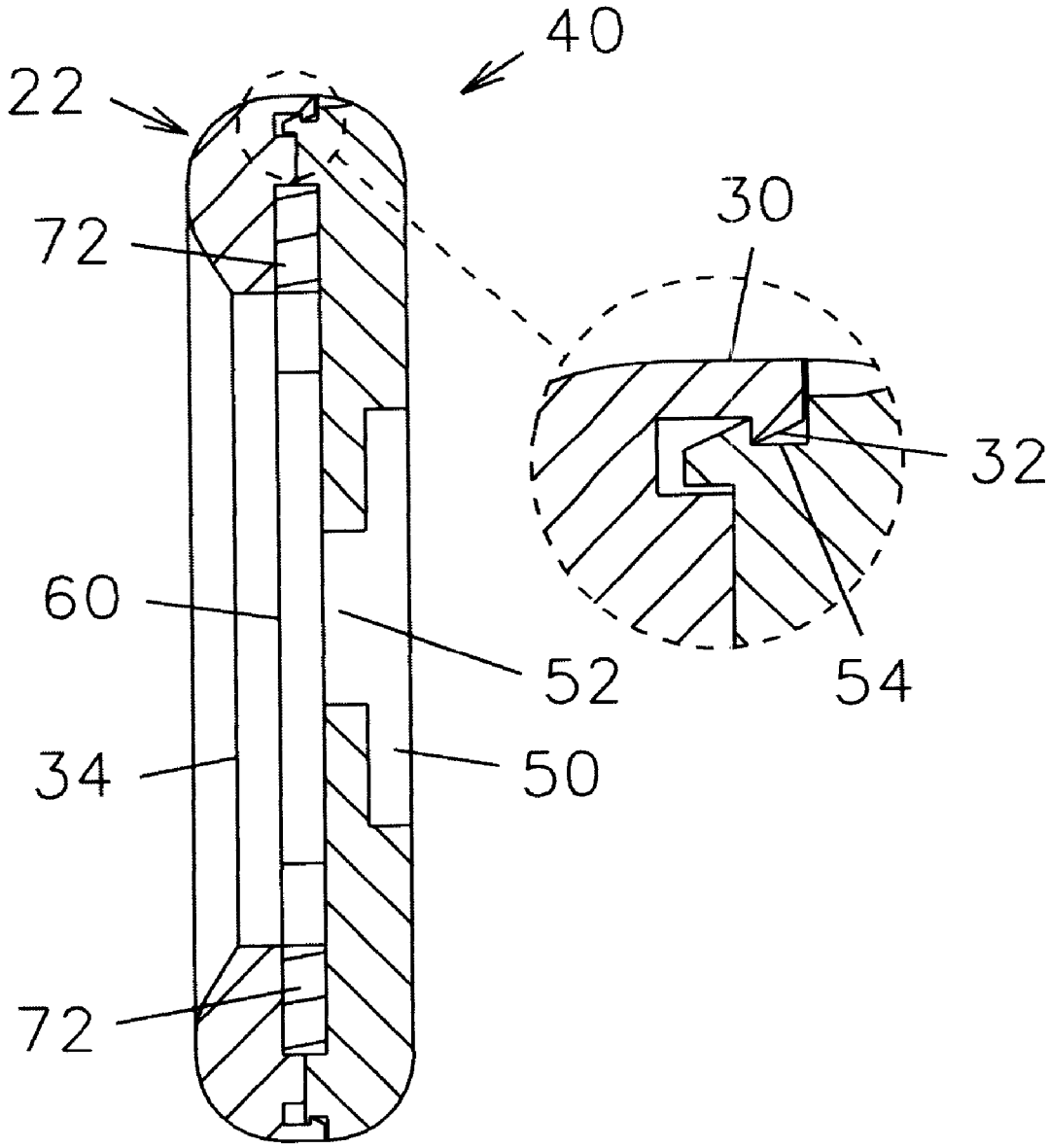
FIG. 7 is a sectional view taken along line 7—7 of FIG. 3*a*.

The scraping and display device 10 includes a two-piece housing 20 having a front section 22 and a rear section 40 that are snap-connectable. The housing 20, therefore, may be selectably assembled and disassembled. The housing 20 is constructed of a rigid plastic material although a lightweight metal would also be suitable. The front section 22 includes upper 24 and lower 26 end walls with opposed elongate side walls 28 extending therebetween. Each side wall 28 of the front section 22 includes a panel 30 depending from a rear edge thereof and having an inwardly oriented flange 32 (FIG. 7). The rear section 40 includes upper 42 and lower 44 end walls with opposed elongate side walls 46 extending therebetween. Each side wall 46 of the rear section 40 forms an elongate notch 48 complementary to each panel 30 and flange 32 of each front section side wall 28 such that a flange 32 is snappably received within a respective notch 48 (FIG. 7).

Figure 5:
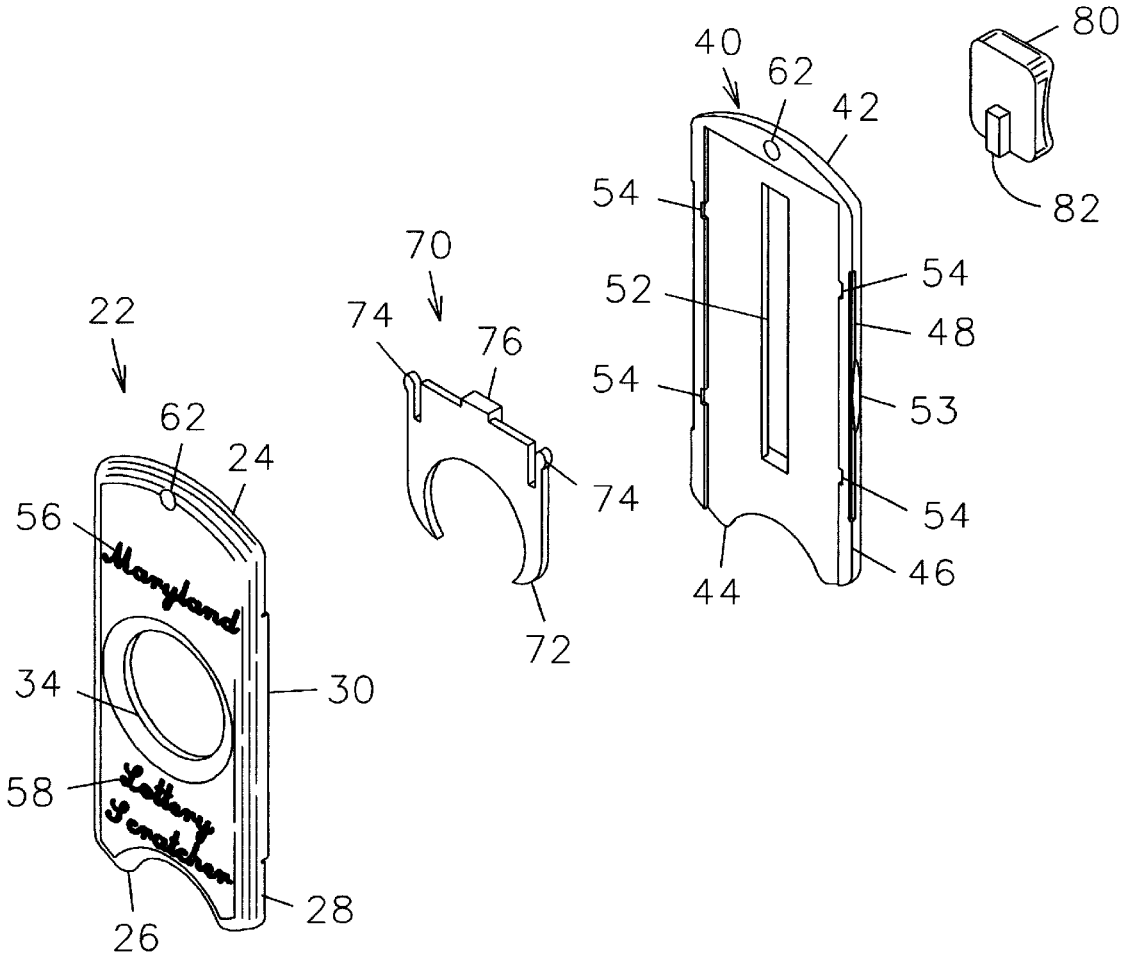
FIG. 5 is an exploded view of the scraper device as in FIG. 1.
Figure 8:
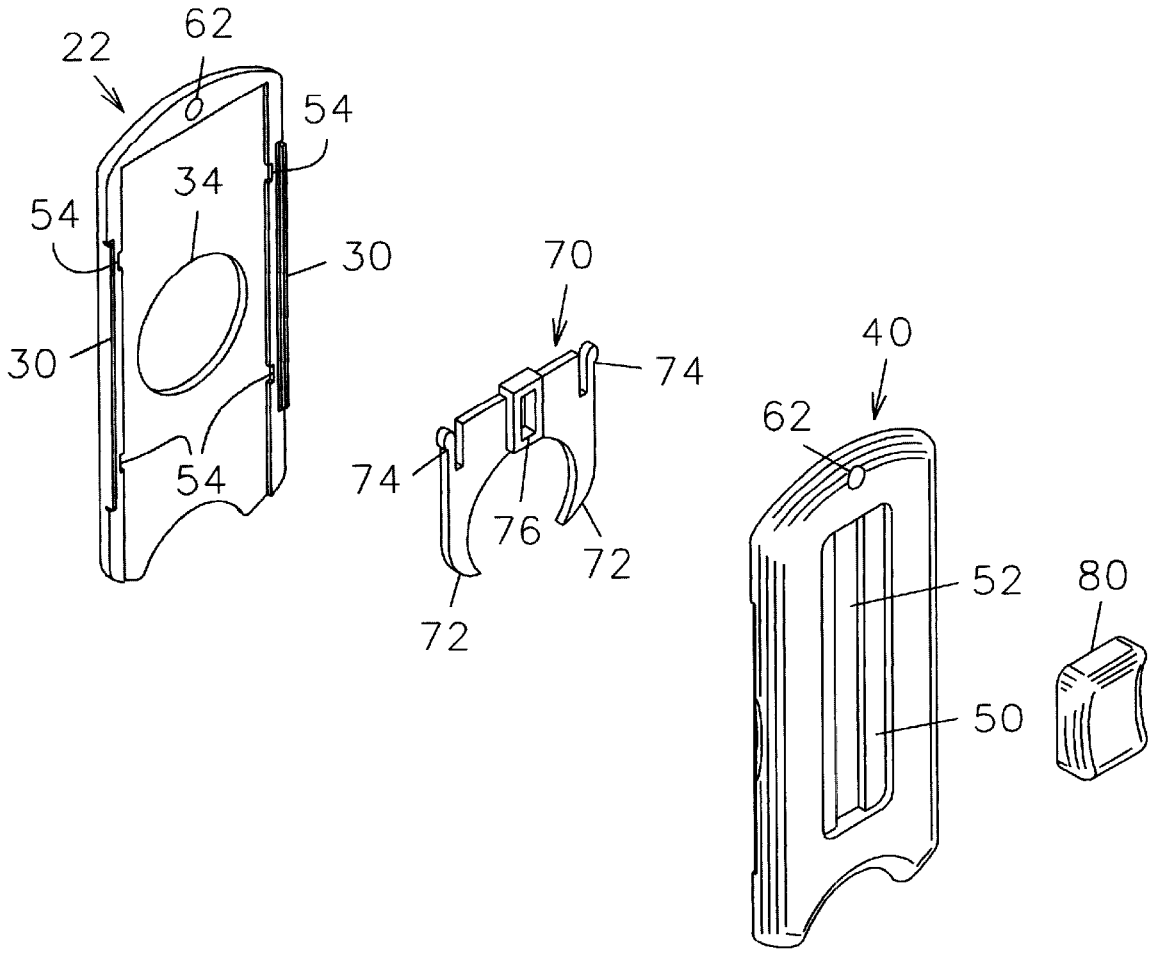
FIG. 8 is an exploded view of the scraper device as in FIG. 6*a*.

A series of notches 54 are formed in inwardly facing edges of the side walls of the front 22 and rear 40 sections and are positioned such that notches of the front section 22 correspond with notches of the rear section (FIGS. 5 and 8). These notches 54 are useful to lock a slider member in a selected position, as to be more fully described below.

Figure 1:
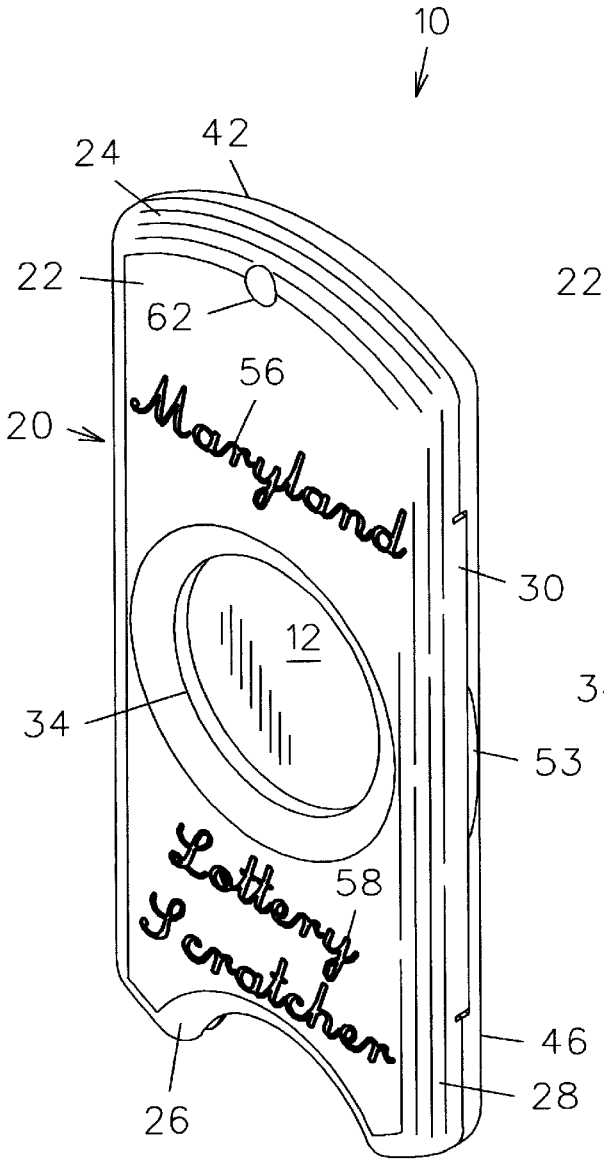
FIG. 1 is a perspective view of a ticket scraper and coin display device according to a preferred embodiment of the present invention with a clamping member and coin at a retracted configuration.

The front section 22 further defines a circular aperture 34 therethrough having a diameter at least as large as a diameter of a commemorative one-dollar state coin 12 (FIG. 1). The aperture 34 is centrally positioned between the edges of the side and end walls such that a coin 12 may be viewed therethrough at a retracted configuration, as to be described more fully below. Optionally, a transparent panel may span the aperture 34 for enhanced protection of the coin 12. The outer surface of the front section 22 further includes indicia 56 indicative of the name of a state within the United States as well as indicia 58 indicating use of the device 10 as a Lottery Scratcher.

Figure 2:
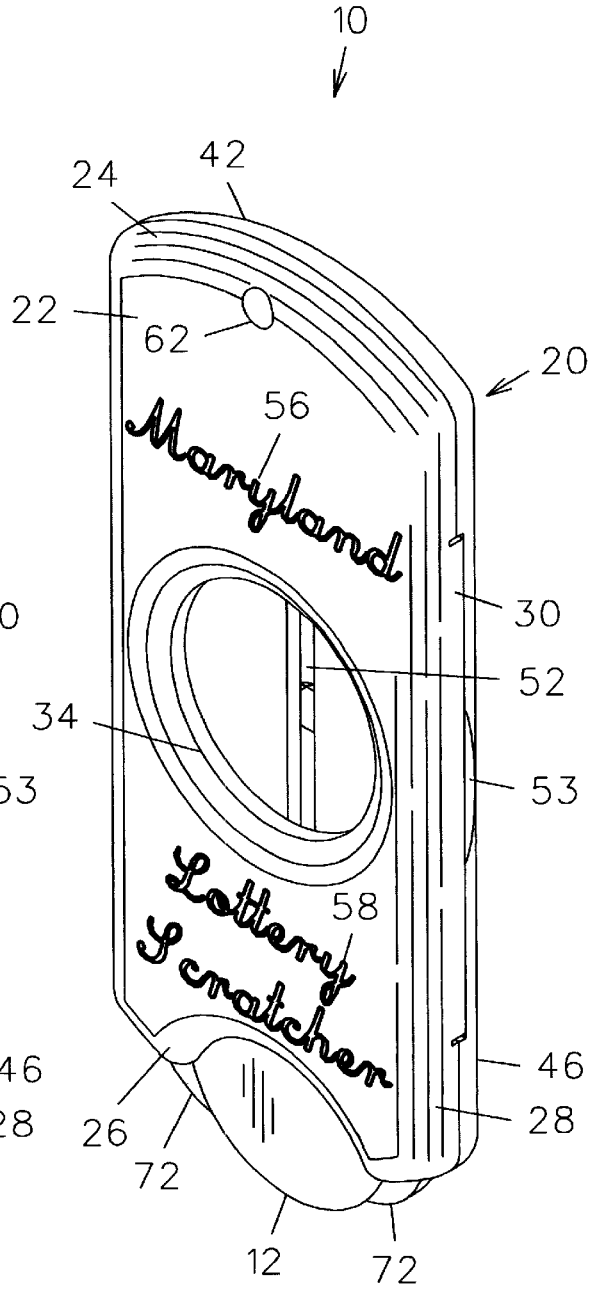
FIG. 2 is a perspective view of the scraper device as in FIG. 1 with the clamping member and coin at an extended configuration.
Figure 3A:
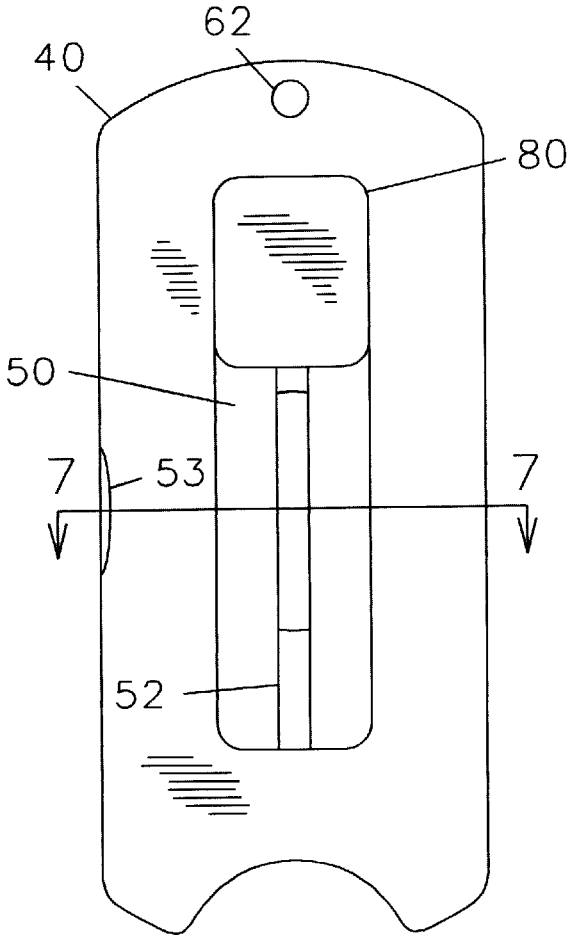
FIG. 3*a* is a rear view of the scraper device as in FIG. 1.
Figure 3B:
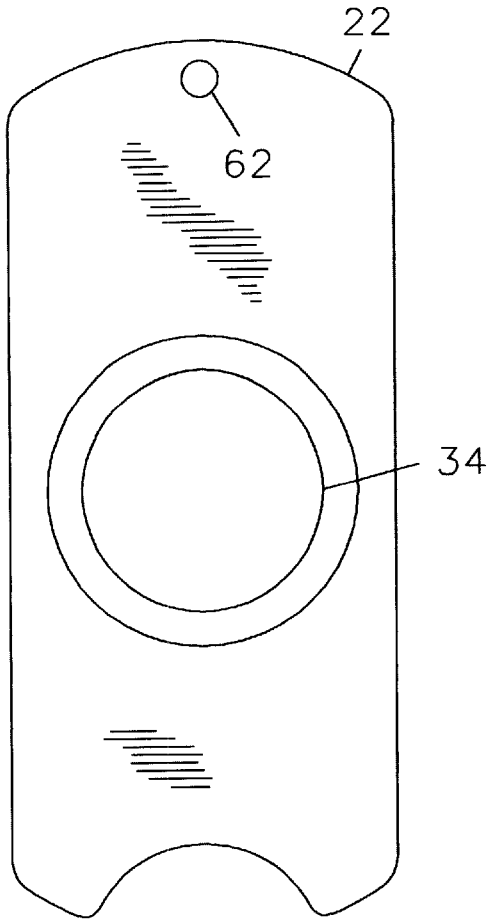
FIG. 3*b* is a front view of the scraper device as in FIG. 1.
Figure 4A:
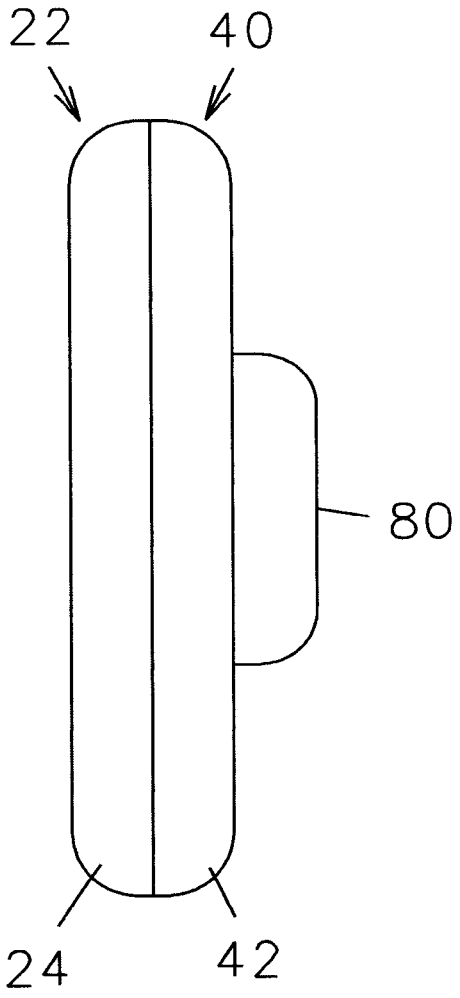
FIG. 4*a* is a top view of the scraper device as in FIG. 1.
Figure 4B:
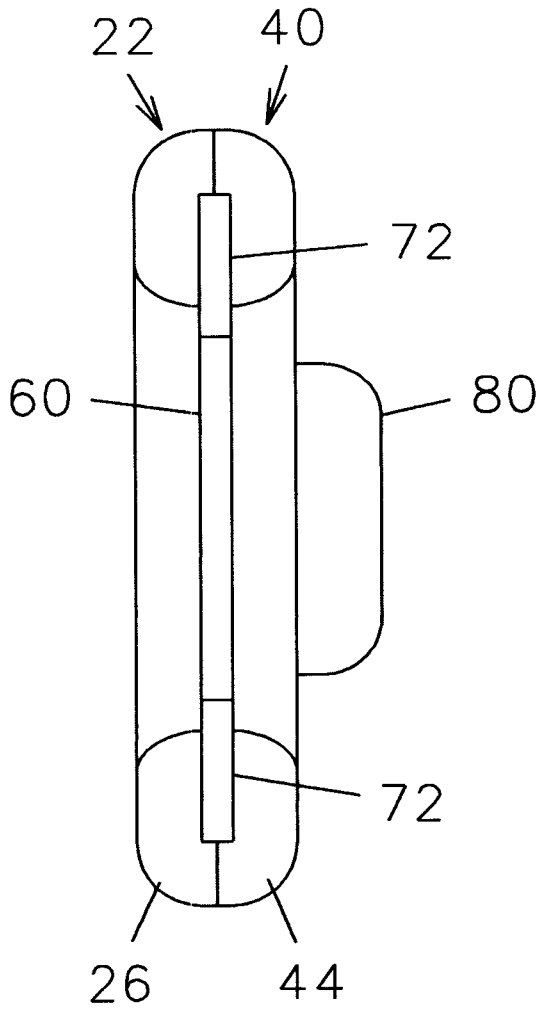
FIG. 4*b* is a bottom view of the scraper device as in FIG. 1.

The rear section 40 defines a generally rectangular recessed area 50 extending longitudinally substantially between upper 42 and lower 44 ends thereof (FIG. 8). A floor of the recessed area 50 defines a slot 52 extending longitudinally therealong. The outer surfaces of the side walls 46 of the rear section 40 further define a depression 53 suitable for placement of a user's thumb or finger therein for prying the front 22 and rear 40 sections apart (FIGS. 1 and 2). Lower ends 26, 44 of the front 22 and rear 40 sections, respectively, have a hemispherical configuration and define an opening 60 through which the coin 12 may extend as to be more fully described below. The front 22 and rear 40 sections further define small circular apertures 62 correspondingly positioned adjacent upper ends 24, 42 thereof for receiving a key ring therethrough.

As best shown in FIGS. 5 and 8, the scraping device 10 further includes a slider member having a clamping member 70 and an actuator button 80. The clamping member 70 comprises a plate constructed of a resilient plastic material having a pair of inwardly annular arms 72 that form a generally circular cutout, the cutout defining an open space between free ends thereof. In other words, the cutout presents a C-shaped configuration. The cutout of the clamping member 70 defines a diameter slightly smaller than a diameter of a commemorative one-dollar state coin 12 so that such a coin may be held in the clamping member 70 in a friction fit relationship. The clamping member 70 further includes a pair of resilient prongs 74 having outwardly extending free ends complementary to the notches 54 formed in the front 22 and rear 40 section side walls. Therefore, the clamping member 70 may be releasably locked into selectable positions within the housing. A coupling 76 is fixedly attached to a rearward surface of the clamping member 70 and defines a rearwardly open cavity therein (FIG. 8).

Figure 6A:
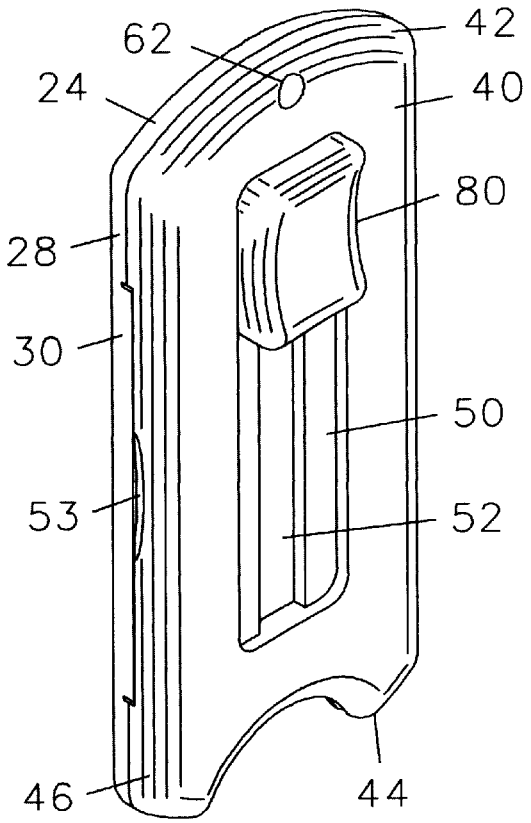
FIG. 6*a* is a rear perspective view of the scraper device as in FIG. 1.
Figure 6B:
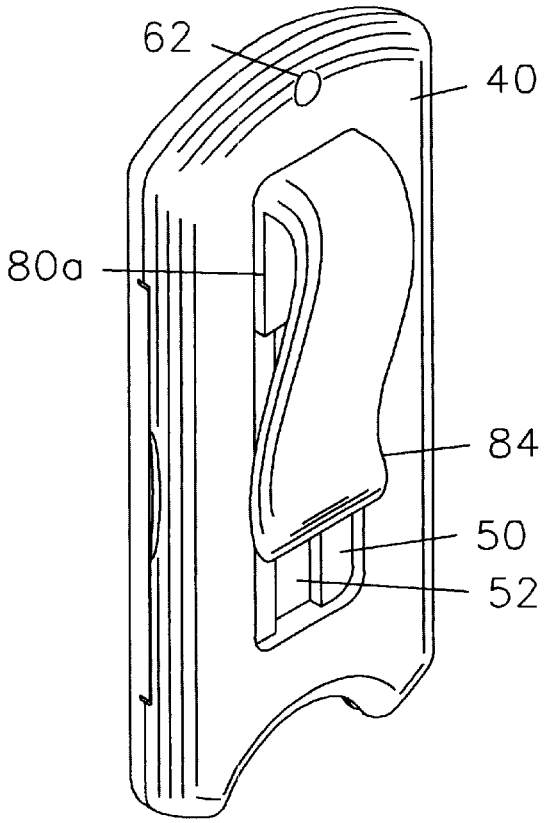
FIG. 6*b* is a rear perspective view of an alternative embodiment of the scraper device of FIG. 6*a;*

The actuator button 80 is generally rectangular and sized to slidably move within the recessed area 50 of the rear section 40 of the housing 20 (FIG. 8). The actuator button 80 includes a flange 82 having a configuration complementary to the cavity of the clamping member coupling 76. When assembled, the flange 82 extends through the slot 52 and is releasably received in the coupling cavity in a friction fit relationship. The actuator button 80 is therefore snappably removable from the clamping member 70 to facilitate replacement of a coin 12 held by the clamping member 70. Further, the clamping member 70 is slidably movable between a fully retracted position wherein the prongs 74 are releasably held within the uppermost pair of notches 54 and an extended position wherein the prongs 74 are releasably held within the lowermost pair of notches 54. In the retracted position, the coin 12 held by the clamping member 70 is completely visible through the circular aperture 34 of the front section whereas the coin 12 extends through the opening 60 at the lower end of the housing 20 when at the extended position. The entire slider member is moved upon a manipulation of the button 80 with a thumb or finger of a user's hand. The button 80 is guided by its position within the recessed area 50 and the flange 82 extending through the longitudinal slot 52 (FIG. 6*a*). Optionally, a conventional belt clip 84 may be integrally attached to an actuator button 80*a* (FIG. 6*b*).

Alternatively, the device 10 may take the form of a money clip having a recessed area for frictionally holding a commemorative coin 12.

In use, a user may place his thumb in the rear section depression 53 and then exert pressure against the front section panel 30 so as to pry the sections apart. The clamping member 70 may then be snappably uncoupled from the actuation button 80 and a selected commemorative one-dollar coin 12 frictionally inserted between the arms 72 of the clamping member 70. The clamping member 70 may then be re-coupled to the actuator button 80 by snapping the coupling cavity into engagement with the actuator button flange 82. The front 22 and rear 40 sections of the housing 20 may also be snappably re-assembled. By manipulating the actuation button 80 into an uppermost position within the recessed area 50, the clamping member 70 holds the coin 12 in a position within the housing 20 in which the coin is viewable through the circular aperture 34 of the front section 22. Conversely, by manipulating the actuator button 80 to its lowermost position, the free ends of the clamping member 70 along with the coin 12 held thereby extend through the opening 60 in the lower end of the housing 20. The coin 12 is held tightly by the clamping member 70 such that it may be used as a scraping blade to remove the protective film from a lottery scratch-off type ticket. Preferably, the coin 12 selected for use with the scraping device 10 corresponds to the state indicated by the indicia 56 imprinted on the outer surface of the front section 22, although other coins may be interchanged therefor in the manner specified above.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A ticket scraping device for using a coin to scrape a protective film from a ticket surface, comprising:

a housing having a front side and a back side defining an opening at a lower end thereof, said front side defining a centrally disposed circular aperture; and a slider member disposed in said housing having an annular clamping member adapted to hold a coin therein, said slider member being selectably movable along a longitudinal path within said housing between a first configuration in which the coin held by said clamping member is visible through said circular aperture and a second configuration in which the coin held by said clamping member is extended from said opening.

2. A ticket scraping device as in claim 1 wherein:

said back side of said housing defines a recess extending longitudinally along an outer surface thereof and defines a slot extending longitudinally along said recess; and said slider member includes an actuator button disposed in said recess and having a flange extending through said slot and releasably coupled to said clamping member, whereby said slider member is slidable along said longitudinal path within said housing upon a longitudinal manipulation of said actuat button by a user.

3. A ticket scraping device as in claim 2 wherein said clamping member is constructed of a resilient material and includes a diameter slightly smaller than a diameter of a commemorative one-dollar coin such that said coin is held in said clamping member in a friction fit relationship.

4. A ticket scraping device as in claim 3 wherein said housing includes opposed side walls defining a series of notches along interior surfaces thereof, said slider member including a pair of outwardly disposed resilient prongs adapted to selectably and releasably mate with respective of said notches upon said user manipulation of said actuator button, whereby said slider member is selectably held at said first or second configuration.

5. A ticket scraping device as in claim 2 further comprising a belt clip fixedly attached to said actuator button.

6. A ticket scraping device as in claim 3 wherein a diameter of said circular aperture of said front side of said housing is at least as large as said diameter of said clamping member, whereby the entire coin held by said clamping member is identifiably visible through said circular aperture at said first configuration.

7. A ticket scraping device as in claim 1 wherein said lower end of said housing includes a hemispherical configuration such that a portion of said clamping member and the coin held thereby extend from said opening in said lower end when said slider member is at said second extended configuration.

8. A ticket scraping device as in claim 1 wherein said housing is constructed of first and second snap connectable housing portions.

9. A ticket scraping device as in claim 1 wherein said front and back sides of said housing define a pair of opposed apertures adjacent an upper end of said housing for receiving a key ring therethrough.

10. A ticket scraping device as in claim 1 wherein said front side of said housing includes indicia corresponding to the coin held by said clamping member.

11. A ticket scraping device for using a coin to scrape a protective film from a ticket surface, comprising:

a two-piece housing having a front section releasably fastened to a rear section and defining an opening at a lower end of said housing, said rear section defining a slot extending longitudinally therealong;

a slider member having a holding portion positioned in said housing adapted to releasably hold the coin and an actuator portion removably coupled to said holding portion and extending through said slot, said slider member selectably movable upon a user movement of said actuator portion between a first configuration in which said holding portion is retracted within said housing and a second configuration in which said holding portion and the coin held therein extend from said opening of said housing;

wherein said holding portion includes a generally rectangular plate having a lower edge defining a C-shaped cutout for partially capturing the coin, said holding portion being constructed of a resilient material and said cutout having a diameter slightly smaller than a diameter of the coin to be held therein such that the coin is held in said cutout of said holding portion in a friction-fit relationship; and wherein said front section defines a circular aperture centrally disposed and having a diameter substantially similar to a diameter of said cutout of said holding portion of said slider member such that the coin held by said holding portion is visible when said slider member is at said first retracted configuration.

12. A ticket scraping device as in claim 11 wherein said rear section of said housing includes a pair of oppositely disposed side walls, each rear section side wall defining an indented channel therealong;

said front section includes a pair of side walls, each front section side wall having a panel depending therefrom complementary to a respective side wall channel of said rear section such that said front and rear sections are fastened together in a snap-fit relationship; and an outer surface of each said side wall of said rear section defines a depression adjacent a respective channel adapted to receive a user's finger therein for separating said front section from said rear section.

13. A ticket scraping device as in claim 12 further including means for holding said slider member in selectable positions within said housing.

14. A ticket scraping device as in claim 11 wherein said front and rear sections define circular apertures adjacent respective upper ends thereof, said apertures being in communication one with the other for receiving a key ring therethrough.

15. A ticket scraping device as in claim 11 wherein said front and rear sections include lower edges defining a hemispherical configuration and forming said opening, whereby a portion of the coin held in said holding portion is extended through said opening at said second configuration.

16. A ticket scraping device as in claim 11 further comprising a belt clip attached to said actuator portion of said slider member.

17. A ticket scraping device as in claim 11 wherein an outer surface of said front section of said housing includes indicia corresponding to the coin held by said holding portion of said slider member.

18. A ticket scraping device for using a coin to scrape a protective film from a ticket surface, comprising:

a two-piece housing having a front section releasably fastened to a rear section and defining an opening at a lower end of said housing, said front section defining a centrally disposed first circular aperture, said rear section defining a slot extending longitudinally therealong;

a slider member comprising:

an annular clamping member removably disposed in said housing and adapted to releasably hold the coin; and an actuator button releasably coupled to said clamping member and extending through said slot, whereby said slider member is, upon a user manipulation of said actuator button, selectably movable along a longitudinal path within said housing between a first configuration in which the coin held by said clamping member is retracted within said housing and visible through said circular aperture and a second configuration in which the clamping member and the coin held thereby are extended from said opening.

* * * * *